US006849676B1

(12) United States Patent
Shibano et al.

(10) Patent No.: US 6,849,676 B1
(45) Date of Patent: Feb. 1, 2005

(54) ANTISTATIC POLYURETHANE ELASTIC FIBER AND MATERIAL FOR PRODUCING THE SAME

(75) Inventors: Michihiro Shibano, Yao (JP); Yoji Mizuhiro, Yao (JP); Masayoshi Yamanaka, Yao (JP)

(73) Assignee: Matsumoto Yushi-Seiyaku Co., Ltd., Osaka (JP)

( * ) Notice: Subject to any disclaimer, the term of this patent is extended or adjusted under 35 U.S.C. 154(b) by 0 days.

(21) Appl. No.: 09/554,736

(22) PCT Filed: Jan. 8, 1999

(86) PCT No.: PCT/JP99/00029

§ 371 (c)(1),
(2), (4) Date: Jul. 10, 2000

(87) PCT Pub. No.: WO99/35314

PCT Pub. Date: Jul. 15, 1999

(30) Foreign Application Priority Data

Jan. 9, 1998 (JP) ..... 10-014890

(51) Int. Cl.[7] ..... C08K 5/41

(52) U.S. Cl. ..... 524/156; 524/127; 524/157; 524/195; 524/196

(58) Field of Search ..... 524/195, 196, 524/127, 156, 157; 558/20–25, 44, 48, 70, 75; 568/852

(56) References Cited

U.S. PATENT DOCUMENTS 3,775,213 A * 11/1973 Dunay ..... 156/244.23
4,600,743 A * 7/1986 Shizuki et al. ..... 524/377
5,294,444 A * 3/1994 Nakamura et al. ..... 424/401
5,658,848 A * 8/1997 Abe et al. ..... 503/227
5,711,994 A * 1/1998 Powers ..... 427/255.6
5,800,920 A * 9/1998 Umezawa et al. ..... 428/364
5,954,062 A * 9/1999 Murata ..... 132/53
6,528,567 B1 * 3/2003 Arai et al. ..... 524/392

FOREIGN PATENT DOCUMENTS

| | | |
|---|---|---|
| JP | 68026878 | 11/1968 |
| JP | 73038470 | 11/1973 |
| JP | 55082181 | 6/1980 |
| JP | 10090258 | 4/1989 |
| JP | 07166426 | 6/1995 |

* cited by examiner

*Primary Examiner*—James J. Seidleck
*Assistant Examiner*—U. K. Rajguru
(74) *Attorney, Agent, or Firm*—Sherman & Shalloway

(57) ABSTRACT

Inorganic salts are generated in the production process of metal salts, such as sulfonates, sulfates and phosphates. When such metal salts containing inorganic salts are added as an antistatic agent to a polymer for producing polyurethane fiber, the inorganic salts cause fiber breakage or pack choking in fiber extrusion process. In addition, such antistatic agents are highly hygroscopic and contain trace of water. When such an antistatic agent is added to the material for polymerizing polyurethane, the alcohol and water in the agent react with isocyanate to result in lowered degree of polymerization and generation of oligomer. Such polyurethane polymer is spun into fiber of low elongation and tenacity. The material for polyurethane elastic fibers of the present invention comprises a mixture of 5 to 95 weight percent of at least one of the above-mentioned antistatic agents and 95 to 5 weight percent of a isocyanate-free starting material for elastic fibers, and eliminates the above troubles.

6 Claims, No Drawings

ANTISTATIC POLYURETHANE ELASTIC FIBER AND MATERIAL FOR PRODUCING THE SAME

TECHNICAL FIELD

The present invention relates to an antistatic polyurethane elastic fiber and the material for producing the same.

PRIOR ART

Japanese Patent Publication Laid-Open Hei 7-166426 describes an elastic yarn containing 0.1 to 5 weight percent of sulfonates having $C_{12-22}$ hydrocarbon chain, of which surface is coated with a finish containing dimethyl siloxane.

Japanese Patent Publication Laid-Open Hei 1-90258 describes a process for producing antistatic polyurethane foam by dissolving an organic sulfonate and phosphonium salt in a dope for producing polyurethane and by reacting the dope into polyurethane.

Inorganic salts are generated as a byproduct in the production process of sulfonates having hydrocarbon chain, sulfates having hydrocarbon chain and phosphates having hydrocarbon chain. Such metal salts containing the inorganic salts result in fiber breakage and pack choking in fiber extrusion process when they are used in a polymer dope for fiber production, because the inorganic salts are insoluble in polymer dope. Therefore the above-mentioned sulfonates and others must be purified with an organic solvent, such as alcohol, to eliminate the inorganic salts before used in the polymer dope. On the other hand, the above-mentioned sulfonates and others are usually hygroscopic and contain trace of water. Thus 1 or more weight percent of alcohol and water remain in the above-mentioned sulfonates and others after they are purified into 100% and treated in vacuum drying. Such sulfonates and others containing alcohol and water lower the degree of polymerization or generate oligomer when they are added in the polymerization process of polyurethane because of the reaction between the alcohol or water in the metal salts and isocyanate. And such polyurethane is spun into fiber of lowered elongation and tenacity.

DISCLOSURE OF INVENTION

The object of the present invention is to provide a material which contains sulfonates and the like having hydrocarbon chain for producing antistatic polyurethane elastic fiber containing the sulfonates and the like having hydrocarbon chain as an antistatic agent.

Another object of the present invention is to provide a material containing minimum alcohol and water to minimize the inhibition of polyurethane formation due to the reaction between the alcohol or water and isocyanate for the purpose of producing antistatic polyurethane.

Further object of the present invention is to provide a material, in which sulfonates and the like are contained as an antistatic agent and the sulfonates and the like contain minimum inorganic salts, for producing antistatic polyurethane elastic fiber.

Further object of the present invention is to provide antistatic polyurethane elastic fiber having sufficient tenacity and elongation as an elastic fiber.

Further object and advantage of the present invention are clearly illustrated in the following description.

First, the above object and advantage of the present invention are achieved by a material for producing antistatic polyurethane elastic fiber comprising a mixture of 5 to 95 parts by weight of at least one salt selected from the group consisting of sulfonates having $C_{8-30}$ hydrocarbon chain, sulfates having $C_{8-30}$ hydrocarbon chain and phosphates having $C_{8-50}$ hydrocarbon chain; and 95 to 5 parts by weight (based on 100 parts by weight of the total of the mixture) of a starting material other than organic isocyanate for producing polyurethane elastic fiber.

Secondly, the above object and advantage of the present invention are achieved by an antistatic polyurethane elastic fiber containing 0.1 to 10 weight percent of the above-mentioned salts and 0.1 to 10 weight percent of lubricants, and having a tenacity of 1 g/de or more and an elongation of 400% or more.

BRIEF DESCRIPTION OF DRAWING

FIG. 1 illustrates the device for measuring the yarn tension in a simulated knitting operation.

PREFERRED EMBODIMENT OF INVENTION

The material referred to in the present invention is a material for producing an antistatic polyurethane elastic fiber. The polyurethane elastic fiber of the antistatic polyurethane elastic fiber is the polyurethane fiber produced from the starting material comprising long-chain glycols such as polytetramethylene glycol and polyesterdiol, and short-chain bifunctional compounds such as 1,2-propylenediamine and 1,4-butanediol. Such fiber can be produced by dissolving polyurethane in spinning solvent to prepare a dope and by spinning the dope in a well-known manner.

The salts applied as an antistatic agent to the material of the present invention are sulfonates having $C_{8-30}$ hydrocarbon chain, sulfates having $C_{8-30}$ hydrocarbon chain and phosphates having $C_{8-50}$ hydrocarbon chain. Either one or more of those salts can be used for the material.

Preferable sulfonates having $C_{8-30}$ hydrocarbon chain are, for example, pottasium alkanesulfonate having 15.5 carbon atoms on the average, lithium alkanesulfonate, having 10.5 carbon atoms on the average, sodium dodecylbenzenesulfonate, sodium dibutylnaphthalenesulfonate, tetrabutyl-phosphonium toluenesulfonate, trioctylmethylammonium toluenesulfonate, sodium polyoxyethylene lauryl ether propane sulfonate, potassium nonylphenyl ether propane sulfonate, sodium petroleum sulfonate and the like.

Preferable sulfates having $C_{8-30}$ hydrocarbon chain are, for example, sodium octyl sulfate, potassium stearyl sulfate, tetrabutylphosphonium cetyl sulfate, sodium polyoxyethylene lauryl ether sulfate, potassium polyoxyethylene nonylphenyl ether sulfate, lithium castor oil sulfate, sodium sulfate methylricinoleate and the like.

Preferable phosphates having $C_{8-50}$ hydrocarbon chain are, for example, sodium mono- and dilauryl phosphate, potassium mono- and distearyl phosphate, sodium mono- and dipolyoxyethylene lauryl ether phosphate, potassium mono- and dipolyoxyethylene nonylphenyl ether phosphate and sodium mono- and dibutyl phosphate.

The said antistatic component of the present invention must be free from the groups reactive with organic isocyanates. And metal salts are preferable as the antistatic component for their antistatic effect.

According to the present invention, the polyurethane elastic fiber contains 0.1 to 10 weight percent, preferably 0.3 to 3 weight percent, of the said antistatic agent. The amount beyond the above range results in insufficient antistatic effect or lowered tenacity and elongation.

The amount of inorganic matter in the antistatic agent is preferably 0.5 weight percent or less, more preferably 0.1 weight percent or less. Greater amount of the inorganic matter causes fiber breakage and spinning pack choking.

The said material of the present invention contains salts such as the above-mentioned sulfonates and a starting material for producing polyurethane elastic fiber other than organic duisocyanates. The preferable ratio of the former, the salts, is 5 to 95 parts by weight and that of the latter, the material, is 95 to 5 parts by weight based on 100 parts by weight of their total.

The latter, the starting material for producing polyurethane elastic fiber includes, for example, long-chain glycols and short-chain bifunctional compounds for producing polyurethane, spinning solvent, lubricants, antioxidants, and ultraviolet-ray absorbers. Either one or more of those materials can be used. Long-chain glycols, spinning solvent, and lubricants are preferable among them.

The long-chain glycols for producing polyurethane include, for example, polytetramethylene glycol, polyesterdiol, polypropylene glycol and polyethylene glycol. Among those compounds, polytetramethylene glycol and polyesterdiol are preferable.

The short-chain bifunctional compounds for producing polyurethane include, for example, succinic acid, adipic acid, ethylene glycol, propylene glycol, 1,4-butanediol, hexanediol, hydrazine, 1,2-propylene-diamine, 1,4-butylenediamine, 1,6-hexamethylenediamine, and m-xylylene-diamine.

The spinning solvent includes, for example, dimethylformamide, N,N'-dimethylacetamide, N,N,N',N'-tetramethylurea, N-methylpyrrolidone, and dimethyl sulfoxide. Among those, N,N-dimethylformamide and N,N-dimethylacetamide are preferable.

The lubricants include, for example, metal salts of saturated higher fatty acid such as magnesium stearate, modified silicones such as amino-modified silicone, alkylether-modified silicone and polyether-modified silicone, and higher fatty acid amide. Among those, modified silicone and bisamide such as ethylenebistearic acid amide are preferable.

The antistatic polyurethane elastic fiber of the present invention can be produced advantageously from the above material of the present invention. The water and alcohol contained in the above-mentioned material of the present invention can be decreased to a very low level before the material is mixed with organic diisocyanates through blending the material with a starting material for producing polyurethane elastic fiber other than organic diisocyanates and drying the mixture in a well-known manner such as drying under low-pressure. The preferable amount of each water and alcohol in the material of the present invention is 0.5 weight percent or less, more preferably 0.1 weight percent or less.

The material of the present invention is processed into polyurethane elastic fiber in a well-known process where the material of the present invention is treated in the same manner as that for an ordinary starting material for producing polyurethane elastic fiber other than organic diisocyanates.

The present invention provides an antistatic polyurethane elastic fiber containing 0.1 to 10 weight percent of the above-mentioned salt as an antistatic agent and 0.1 to 10 weight percent of a lubricant, and having a tenacity of 1 g/de or more and elongation of 400% or more.

The fiber of the present invention can be produced from the said material of the present invention without decrease of the degree of polymerization, generation of oligomer, lowered tenacity and elongation of resultant fiber and generation of deposit, owing to the low amount of water, alcohol and inorganic salt in the material. In addition, the fiber of the present invention has uniform antistaticity because the antistatic component being dispersed in the material prior to fiber production easily mixes into spinning dope and disperses homogeneously.

EXAMPLES

The present invention is specifically explained with the following examples.

Example 1

Mono- and dipolyoxyethylene lauryl ether phosphate was neutralized with an aqueous solution containing 50-% potassium hydroxide and made into a polytetramethylene glycol solution containing 50% of mono- and dipolyoxyethylene lauryl ether phosphate. The solution was heated up to 130° C. and the water in the solution was evaporated at −700 mmHg to obtain polytetramethylene glycol solution of potassium mono- and dipolyoxy-ehtylene lauryl ether phosphate containing 200 ppm of water and 0.05 weight percent of inorganic salt (hereinafter referred to as Additive a).

Example 2

Crude sodium octyl sulfate containing sodium sulfate decahydrate was dissolved in ethanol to precipitate sodium sulfate decahydrate and filtered. The filtered solution was dried to obtain a powder containing 0.05 weight percent of ethanol, 0.02 weight percent of water and 0.01 weight percent of inorganic salt. Then the powder was made into N,N-dimethyl acetoamide (DMAc) solution containing 10 weight percent of the powder (hereinafter referred to as Additive b).

Example 3

Crude dodecylbenzenesulfonic acid containing sulfuric acid was neutralized with a mixture of sodium hydroxide and methanol to precipitate sodium sulfate decahydrate and to obtain a methanolic solution containing 70% of sodium dodecylbenzenesulfonate. Sixty seven parts by weight of polyether-modified silicone (EO:PO=60:40, viscosity 3000 cSt at 25° C.) was added to 47 parts by weight of the solution, and the mixture was heated up to 130° C. to evaporate methanol at −700 mmHg and to obtain a solution containing 0.06 weight percent of water, 0.05 weight percent of methanol and 0.01 weight percent of inorganic salt (herein-after referred to as Additive c).

Example 4

Crude sodium alkanesulfonate having 15.5 carbon atoms on the average and containing sodium sulfate decahydrate was dissolved in methanol to precipitate sodium sulfate decahydrate and was filtered. After filtering the solution, ethylenebisstearic acid amide was added to the solution to 20 weight percent of the sodium alkanesulfonate having 15.5 carbon atoms on the average. Then the solution was heated up to 130° C. and vacuum dried at −700 mmHg to obtain a solution containing 0.4 weight percent of water, 0.1 weight percent of methanol and 0.02 weight percent of inorganic salt (hereinafter referred to as Additive d).

Example 5

The mixture of 98 parts by weight of polytetramethylene glycol of 1500 number average molecular weight, 2 parts by weight of Additive a, and 33 parts by weight of 4,4-diphenylmethane diisocyanate was reacted at 70° C., and then 266 parts by weight of N,N-dimethylacetamide was added to dissolve the reacted mixture with cooling. After the solution was cooled down to 5° C., a solution prepared by dissolving 5 parts by weight of 1,2-diaminopropane in 184 parts by weight of N,N-dimethylacetamide, and 10 parts by weight of Additive a were added to the solution. The spinning dope prepared in the above procedure was fed to a spinneret having four fine holes, and extruded at 200 m/min into hot air in which solvent was evaporated. The extruded fiber was applied with 5 parts by weight of a 1 to 1 mixture of a dimethyl silicone having a viscosity of 10 cSt and a mineral oil of 60 sec, and wound up into 40 denier thickness. The properties of the resultant fiber are shown in Table 1.

Example 6

The mixture of 100 parts by weight of polytetramethylene glycol of 2000 number average molecular weight and 25 parts by weight of 4,4-diphenylmethane diisocyanate was reacted at 70° C. Then 250 parts by weight of N,N-dimethyl acetoamide was added to the reaction mixture to dissolve the mixture with cooling. After cooling down the solution at 5° C., a solution prepared by dissolving 3.7 parts by weight of 1,2-diaminopropane in 183 parts by weight of N,N-dimethylacetamide and 10 parts by weight of Additive b were added to the solution. The spinning dope obtained in the above procedure was spun into fiber in the same manner as in Example 5. The properties of the resultant fiber are shown in Table 1.

Example 7

A fiber was spun in the same manner as in Example 6 except that 2 parts by weight of Additive c was added instead of 10 parts by weight of Additive b. The properties of the resultant fiber are shown in Table 1.

Example 8

The mixture of 100 parts by weight of polymethylpentanediol adipate of 2000 number average molecular weight, 9 parts by weight of 1,4-butanediol, 37.5 parts by weight of 4,4-diphenylmethane diisocyanate, and 2 parts by weight of Additive d was reacted at 85° C. The resultant reaction product was taken out of the kneader, and extruded at 200° C. from four fine holes with an extruder at 200 m/min. The extruded fiber was applied with 5 parts by weight of a 1 to 1 mixture of a dimethyl silicone having a viscosity of 10 cSt and a mineral oil of 60 sec, and wound into 40 denier thickness. The properties of the resultant fiber are shown in Table 1.

Example 9

A fiber was spun in the same manner as in Example 8 except that the amount of Additive d was changed to 0.5 parts by weight. The properties of the resultant fiber are shown in Table 1.

Example 10

A fiber was spun in the same manner as in Example 6 except that 0.5 parts by weight of Additive c was added instead of 10 parts by weight of Additive b. The properties of the resultant fiber are shown in Table 1.

Comparative Example 1

A fiber was spun in the same manner as in Example 7 except that a commercially available alkanesulfonate having 14.5 carbon atoms on the average (containing 4 weight percent of inorganic salt and 2 weight percent of water) instead of Additive c. The pack pressure increased when the dope was extruded from the spinneret, and the dope could be extruded only for 5 hours. The resultant elastic yarn had an elongation of 270% and a tenacity of 0.5 g/de, and was not used as elastic yarn.

Comparative Example 2

An elastic yarn was spun in the same manner as in Example 1 except that no additives were added. The properties of the resultant fiber are shown in Table 1.

Knitting tension:

The testing mechanism of a yarn in knitting operation is shown in FIG. 1. A polyurethane yarn (2) unwound from a cheese (1) is driven through a compensator (3), rollers (4), knitting needles (5), a roller (7) attached to a U-gauge (6), and a speed meter (8), and connected to a winding roller (9). Yarn speed was controlled constant at a given speed (for example, 10 m/min or 100 m/min) with the speed meter (8), and a yarn was wound onto the winding roll. The variation of the yarn tension while the winding operation was measured with the U-gauge (6) to determine the friction (g) between the yarn and the knitting needles.

Static charge:

An electrometer (KS-525, Kasuga Electric Company) was placed 1 cm above the U-gauge, and the static charge on the driven yarn was detected.

Specific resistance:

The specific resistance was tested with a Fiber Tester (Type MR-2010, Dempa Ind. Co., Ltd.).

TABLE 1

| Test No. | Ex. 5 | Ex. 6 | Ex. 7 | Ex. 8 | Ex. 9 | Ex. 10 | Comp. Ex. 2 |
|---|---|---|---|---|---|---|---|
| Knitting tension (g) | | | | | | | |
| 10 m/min | 20 | 21 | 20 | 20 | 21 | 20 | 20 |
| 100 m/min | 25 | 27 | 23 | 25 | 25 | 24 | 25 |
| Static charge (kv) | | | | | | | |
| 10 m/min | 0.1 | 0.1 | 0.1 | 0.2 | 0.3 | 0.1 | 0.5 |
| 100 m/min | 0.2 | 0.2 | 0.1 | 0.3 | 0.3 | 0.2 | 2.0 |
| Specific resistance (Ω · cm) | $2 \times 10^8$ | $3 \times 10^8$ | $1 \times 10^8$ | $4 \times 10^8$ | $5 \times 10^8$ | $2 \times 10^8$ | $4 \times 10^{11}$ |

TABLE 1-continued

| Test No. | Ex. 5 | Ex. 6 | Ex. 7 | Ex. 8 | Ex. 9 | Ex. 10 | Comp. Ex. 2 |
|---|---|---|---|---|---|---|---|
| Tenacity (g/de) | 2.3 | 2.6 | 2.4 | 2.3 | 2.0 | 2.4 | 2.3 |
| Elongation (%) | 590 | 620 | 610 | 560 | 570 | 610 | 580 |

Ex.: Example
Comp. Ex.: Comparative Example

The material of the present invention enables to produce yarn having superior properties (elongation of 400% or more and tenacity of 1 g/de or more), to =prevent static charge on elastic yarn in covering and beaming process, and to decrease troubles such as yarn breakage.

What is claimed is:

1. A material for producing antistatic polyurethane elastic fiber, said material being the mixture (of which total is 100 parts by weight) of 5 to 95 parts by weight of at least one salt selected from the group consisting of sulfonates having $C_{8-30}$ hydrocarbon chain, sulfates having $C_{8-30}$ hydrocarbon chain and phosphates having $C_{8-50}$ hydrocarbon chain, and 95 to 5 parts by weight of a starting material for producing polyurethane elastic fiber other than organic isocyanate.

2. The material in claim 1, wherein the starting material for producing polyurethane elastic fiber comprising long-chain glycol for producing polyurethane, spinning solvent, and lubricants.

3. The material in claim 2, wherein the long-chain glycol for producing polyurethane elastic fiber is polytetramethylene glycol or polyesterdiol.

4. The material in claim 2, wherein the spinning solvent is N,N-dimethyl-formamide or N,N-dimethylacetamide.

5. The material in claim 1, wherein the lubricants are bisamides or modified silicones.

6. An antistatic polyurethane elastic fiber containing 0.1 to 10 weight percent of at least one salt selected from the group consisting of sulfonates having $C_{8-30}$ hydrocarbon chain, sulfates having $C_{8-30}$ hydrocarbon chain and phosphates having $C_{8-50}$ hydrocarbon chain (in which 0.5 weight percent or less of inorganic salts to the weight of the metal salts are contained), and 0.1 to 10 weight percent of the lubricants, and having a tenacity of 1 g/de or more and an elongation of 400% or more.

* * * * *